United States Patent [19]

Young

[11] 3,959,044

[45] May 25, 1976

[54] PARTICULATE HIGH EXPLOSIVE OF $NH_4NO_3$ - $CASO_4$ - SENSITIZER

[75] Inventor: Donald C. Young, Fullerton, Calif.

[73] Assignee: Union Oil Company of California, Brea, Calif.

[22] Filed: Mar. 17, 1975

[21] Appl. No.: 558,659

[52] U.S. Cl. ..... 149/41; 149/43; 149/44; 149/38; 149/39; 149/46; 149/60; 149/48; 149/49; 149/51; 149/52; 149/55; 149/56; 159/57; 149/112

[51] Int. Cl.[2] ..... C06B 33/14

[58] Field of Search ..... 149/43, 44, 46, 38, 149/39, 60, 48, 41, 49, 55, 56, 51, 52, 57, 112

[56] References Cited

UNITED STATES PATENTS 3,839,107 10/1974 Clark et al. ..... 149/46 X

*Primary Examiner*—Stephen J. Lechert, Jr.

*Attorney, Agent, or Firm*—Richard C. Hartman; Dean Sandford; Michael H. Laird

[57] ABSTRACT

Particulate high explosives containing ammonium nitrate and organic or inorganic ammonium nitrate sensitizers are disclosed along with methods of producing the same. The sensitizers, comprising sulfur, metals, carbonaceous material and combinations of these, are dispersed throughout each particle in intimate association with the ammonium nitrate by suspension in a layer of ammonium nitrate-calcium sulfate reaction product.

12 Claims, No Drawings

PARTICULATE HIGH EXPLOSIVE OF $NH_4NO_3$ - $CASO_4$ - SENSITIZER

BACKGROUND OF THE INVENTION

Ammonium nitrate high explosives are widely used either alone or in combination with other high explosives as binary explosives. They are particularly suitable for excavation and other applications requiring relatively low brisance number. Brisance number characterizes detonation rate, a factor which is reflected in the explosives' ability to move or displace large volumes of earth or similar material or to fracture hard rock.

The acceptance of ammonium nitrate explosives has been occasioned in part by its explosive characteristics, i.e., low brisance number, its low cost, ease of manufacture and susceptibility to mechanical handling. It is also a relatively powerful explosive, with some compositions having 120 percent the strength of TNT. The compound, alone, is not explosive unless retained under extremely high pressures and temperatures. For practical purposes it is necessary to add amounts of sensitizers sufficient to render the combination explosive. A wide variety of sensitizers are known for this purpose, including natural and synthetic organic carbonaceous materials such as mineral and vegetable oils, waxes, animal fats, distillate residues, sugars, coal, the several forms of carbon including coke, graphite, etc., elemental sulfur and powdered, flaked or otherwise finely divided metals such as aluminum, zinc and magnesium.

Suitable combinations of these sensitizers with ammonium nitrate can be produced by numerous procedures. Adequate combinations have been formed by simply mixing ammonium nitrate granules or powder with fuel oils or by adding the sensitizer to a melt or solution of ammonium nitrate and then solidifying and granulating the combination.

All of these approaches suffer from one or more of several disadvantages. The simple admixture of oils and ammonium nitrate particles forms a sticky mass in which all the particles adhere to each other making them difficult to handle. Ammonium nitrate solutions or melts are incompatible with many of the more preferred sensitizers such as hydrophobic mineral oils, and their use requires additional solidification and granulation procedures described above. Many procedures require melted or dissolved ammonium nitrate and, accordingly, do not take advantage of the fact that ammonium nitrate is widely available in particulate or prill form.

It would be preferable to convert these particles directly to useable explosives without the need of destroying and then reproducing the original physical form. Smaller particles afford ease in mechanical handling in transportation and container loading.

However, an appropriate manufacturing method must provide even sensitizer distribution, should not require the use of types or amounts of inert materials that detract substantially from product quality, or result in the formation of cohesive particles.

Presumably these objectives could be accomplished by mixing the sensitizer and other components with the ammonium nitrate melt or solution during the prilling operation itself. This is often impossible, however, due to incompatibility of the sensitizer with melts or solutions. This approach also complicates prilling operations in a manner which may or may not be easily solvable or economically acceptable. It is hardly feasible to convert commercial prilling facilities into piecemeal explosive manufacturing operations.

Due to the wide availability of particles or prills as such, it would of course be desirable to devise a method of combining sensitizers with available particles on a limited scale without appreciable difficulty, a method that would not require interference with large-scale particle production in the first instance. This approach is also complicated, however, by several factors, primarily physical structure (low porosity and permeability) and sensitizer incompatibility. Ammonium nitrate prills have extremely low porosity, certainly insufficient surface porosity to retain the necessary amounts of sensitizer without agglomeration. Thus, very little if any material can be added to the particle surface by a simple procedure.

It is therefore one object of this invention to provide an improved particulate ammonium nitrate explosive composition. Another object is a provision of a simple method for combining ammonium nitrate particles and sensitizers. Another object is the provision of a method for converting commercially available ammonium nitrate particles or prills into non-adherent, free-flowing, particulate explosives.

DETAILED DESCRIPTION OF THE INVENTION

I have now discovered that particulate ammonium nitrate explosives containing conventional sensitizers can be produced by incorporating the sensitizer in a peripheral layer formed by the reaction of calcium sulfate dihydrate with ammonium nitrate particles. In a preferred embodiment, the prills are mixed with minor amounts of calcium sulfate dihydrate and the required amounts of sensitizers, either in fluid or finely divided solid form, and the mixture is heated to a temperature sufficient to promote the endothermic reaction of calcium sulfate and ammonium nitrate. This reaction forms a layer of reaction product of calcium sulfate and ammonium nitrate at least at the outer surfaces of the original particle. This layer is much more porous than the original prill. It firmly encapsulates the sensitizer in an evenly distributed pattern around the ammonium nitrate and in intimate association therewith.

There is little reason to anticipate this result. The sensitizer does not participate in the reaction. Moreover, this reaction must proceed at the calcium sulfate-ammonium nitrate interface beyond which the sensitizers would not be expected to penetrate. Thus it would not be expected that, nor is it presently understood how, the sensitizers are captured and retained in the reaction product layer. Nevertheless they are retained in and evenly distributed throughout the reaction product in close contact with the ammonium nitrate. Moreover, even though this procedure forms a physically stable combination of sensitizer, calcium sulfate and ammonium nitrate, the particles are not cohesive and do not agglomerate.

In another embodiment the calcium sulfate-ammonium nitrate product is preformed by the described reaction after which the sensitizers are added. This approach requires the use of liquid sensitizers or those which can be melted at acceptable temperatures, e.g., less than about 300°F. Although less preferred, sensitizer solutions can also be used provided they do not dissolve or melt the particles. Although the calcium sulfate-ammonium nitrate particles can tolerate higher moisture levels than the original prills, substantial water levels are preferably avoided due to the possibility of dissolving or "melting" the ammonium nitrate.

In another embodiment, particulate binary explosives are produced by a procedure similar to that described above in which the ammonium nitrate particles, finely divided calcium sulfate, and sensitizer are combined along with a second high explosive and the combination is then formed into a particulate aggregate by heating to the reaction temperature. Both the sensitizer and second explosive are encapsulated in the reaction product layer.

The sensitizers and additional explosives do not in and of themselves constitute a novel aspect of this invention beyond the extent that they are encapsulated in a physically stable, non-cohesive particulate combination with ammonium nitrate.

Ammonium nitrate sensitizers and high explosives are well known in the art. Novel combinations of any of these materials with the ammonium nitrate and calcium sulfate can be obtained by these procedures. Thus the selection of sensitizers and additional explosives is largely a matter of choice. The effect of these materials on particle stability can be readily determined by simply preparing sample compositions and determining whether or not the particles have sufficient structural strength. This is largely a function of calcium sulfate content. Larger additive levels can be retained at higher calcium sulfate concentrations. Thus, as a general rule calcium sulfate concentration should be at least equal to the combined weight of sensitizer and additional explosive.

Commercially available nitrate particles include prills, pellets and granules. The prills are presently preferred due to their wide availability and low cost. Commercial prills generally have particle sizes ranging between about 5 and about 30 standard mesh sizes. The smaller particles are generally preferred in explosives due to their higher surface area and consequent ease of detonation and more rapid detonation rate.

Due to the desirability of producing a particle-form product having the general dimensions of the ammonium nitrate starting material (allowing for some increase in diameter due to additional components), it is presently preferred that the starting materials and process conditions be sufficiently anhydrous to avoid dissolving or melting the ammonium nitrate or producing a cohesive particle which might promote agglomeration. Thus the nitrate starting material preferably contains less than about 5 weight percent free moisture determined by dehydration for 2 hours at 210°F. Similarly, process conditions should be maintained such that substantial amounts of free water are not taken up by the ammonium nitrate or other components during processing. This is not to say that completely anhydrous conditions must be maintained. On the contrary, I have discovered that somewhat better results and more complete calcium sulfate and ammonium nitrate utilization are obtained with some free water present.

Optimum free water content is influenced by several factors. The free water level should be sufficient to convert all of the calcium sulfate to the dihydrate if it is not originally present in that form. Calcium sulfate dihydrate (gypsum) is believed to be the reactive species in this procedure. Although the conversion of anhydrous calcium sulfate or the hemihydrate to the dihydrate is relatively slow at ambient conditions, it rapidly proceeds to completion in a matter of several minutes at elevated temperatures, e.g., 100°F. or higher. Thus, anhydrous calcium sulfate or the hemihydrate can be used either alone or in combination with the dihydrate as starting materials. However, calcium sulfate hydration level must be taken into consideration in determining the amount of free water added or retained in all of the components. This level should not be so great as to either dissolve any substantial amount of the ammonium nitrate or so reduce its melting point that it becomes molten or cohesive in the reaction system. Accordingly, as a general rule, the initial free water level should not exceed about 15 weight percent of the combined weight of ammonium nitrate and calcium sulfate.

The optimum water level is best determined emperically since it is influenced by the initial calcium sulfate hydration level, ammonium nitrate water content, and the nature and quantity of impurities in either the calcium sulfate or ammonium nitrate. These impurities themselves may be hydratable. Thus they may compete with the calcium sulfate for available free water at the reaction temperature.

Optimum water level can be readily determined by performing a series of tests using the available calcium sulfate, ammonium nitrate and sensitizer, and adding different amounts of free water to the reaction mixture either prior to or during heating to the reaction temperature. Insufficient free water will be indicated by excessive dusting, the lack of complete reaction and the formation of non-uniform, fragmented or unstable particles. Excess free water is indicated by the formation of agglomerates or a sticky mass of material resulting from the melting and/or dissolving of ammonium nitrate. The use of water levels between these limits will result in the production of suitable particles.

The calcium sulfate should be finely divided and is preferably powdered. It is also preferably, although not necessarily, at least partially hydrated. The most common hydrates are the hemihydrate commonly known as plaster of Paris and the dihydrate known as gypsum.

The calcium sulfate does not participate in detonation. Accordingly, its concentration should be only to that necessary to obtain adequate particle coverage and distribution of sensitizers and additional high explosives when used. Thus the sulfate concentration is usually at least about 5 weight percent, preferably between about 5 and about 20 weight percent, based on the combined dry weight of calcium sulfate and ammonium nitrate. Conversely, the ammonium nitrate should constitute at least about 60, preferably at least about 80, weight percent of the combination based on the dry weight of these two materials.

Ammonium nitrate sensitizers include numerous combustible carbonaceous materials well known in the art and discussed in numerous publications. Either liquid or finely divided solid sensitizers can be employed when they are incorporated with the ammonium nitrate-calcium sulfate mix prior to reaction. Fluid sensitizers are required with preformed calcium sulfate-ammonium nitrate particles. The term "fluid sensitizer" includes materials which are liquid at ambient condition or which have melting points below an acceptable temperature, i.e., less than about 300°F.

Illustrative fluid sensitizers are crude petroleum and the different grades of materials obtained by fractionating or otherwise refining crude oils. These include furnace oils, gas oils, bright stocks, neutral oils, bunker fuel oils; distillate residues such as asphalt, tar, pitch waxes and the like. Chemically modified hydrocarbons are also suitable, e.g., hydrogenated or sulfonated products. Similar grades of either vegetable or synthetic oils and waxes are also suitable including substituted or unsubstituted low molecular weight olefin or addition polymers including polyethylene, polyisobutylene, polystyrene and copolymers of these and other monomers. Polyhydric alcohols such as glycol and ethylene oxide condensates are also contemplated.

Solid sensitizers include powdered, flaked or otherwise finely divided metals such as aluminum, zinc and magnesium, elemental sulfur, natural or synthetic cellulosic fibers such as cotton and other dried plant fibers as well as synthetic analogs thereof, sugars including sucrose, fructose, galactose, etc., and pulverized carbonaceous materials such as coal, coke, charcoal, or other carbon forms.

As an explosive, ammonium nitrate is overbalanced in oxygen. This factor necessitates the use of sensitizers of the type described above. Accordingly, the most efficient detonation is achieved with stoichiometric sensitizer concentrations, i.e., the amount required to consume the excess oxygen in the ammonium nitrate molecule upon detonation. For instance, a suitable stoichiometric combination can be formed with 94.5 weight percent ammonium nitrate prills and 5.5 weight percent of a fuel oil range hydrocarbon boiling between 500°and 750°F. Nevertheless, detonation can be achieved at very low sensitizer concentrations, i.e., on the order of about 0.5 weight percent based on a combined weight of sensitizer and ammonium nitrate. Thus, the sensitizer concentration will be at least about 0.5, generally about 0.5 to about 20, and preferably between about 1 and about 10 weight percent based on the combined weight of ammonium nitrate and sensitizer.

Detonation can be achieved under either confined or unconfined conditions. However, while the confined compositions can be detonated with conventional blasting caps, e.g., a No. 8 blasting cap, more severe conditions are required when the materials are relatively unconfined. Numerous commercial detonating compositions are adequate for this purpose. Illustrative of these are tetryl (2,4,6-trinitrophenylmethylnitramine), DDPN (diazodinitrophenol), PETN (pentaethythritol tetranitrate), mercury fulminate, $Hg(ONC)_2$, lead and silver azides, and the like. These detonators can be used either alone or in combination with one or more other high explosive booster charges.

The required amount of detonator can be substantially reduced by using it to detonate a high explosive booster such as TNT, nitrocellulose or the like, which in turn serves to detonate the ammonium nitrate explosive. The amount of detonating material and/or secondary explosive required to assure reliable detonation is also a function of the degree of containment of the particulate explosive, packing density, the explosive composition, and the like. Several routine tests are widely employed in the art to determine the optimum combination of detonator and explosives under either confined or unconfined conditions. Thus combinations of different detonating compositions or combinations of detonators and secondary high explosives can be combined with the ammoniun-nitrate sensitizer particles in different concentrations and subjected to these standard detonation tests to determine which concentrations and combination of detonator and secondary explosives give the best results.

In addition to their use as detonators, secondary explosives such as TNT, nitrocellulose, dinitrotoluene, glycerol nitrate, and the like can be combined with the particulate ammonium nitrate-sensitizer combinations to produce so-called binary explosives having differing explosive characteristics. Included among these characteristics are ease of detonation, brisance number, sensitivity, stability, volatility, reactivity, cost, availability, hygroscopic nature and shock intensity for a given charge size. One or more secondary explosives can be employed to produce the desired composition.

The secondary explosive content will generally exceed about 0.5 weight percent but can range from 0.5 to 90 weight percent. However, for most applications, the particulate ammonium nitrate explosive will constitute at least about 70 weight percent and the secondary explosive will account for about 5 to about 30 weight percent of the charge.

EXAMPLE 1

This example illustrates a method by which a binary explosive containing nitrocellulose, a hydrocarbon fuel oil sensitizer and ammonium nitrate can be produced. The following components can be added to a one-gallon open vessel provided with a low speed solids mixer; 200 grams ammonium nitrate prills, 30 grams of calcium sulfate dihydrate containing 8 percent free water, 10 grams nitrocellulose and 18 grams of a hydrocarbon gas oil boiling between 500° and 800°F. These materials can be mechanically mixed for several minutes to promote even distribution. The vessel is then heated at a rate of about 3°F. per minute to a temperature of 250°F. The reaction between the calcium sulfate dihydrate and ammonium nitrate will commence at approximately 220°F. as indicated by a sharp reduction in the temperature of the mixed solids occasioned by the endothermic reaction.

The resultant particles comprising combinations of the above reactants can be recovered, screened to remove unreacted fines of calcium sulfate, and either stored or transferred into the desired containers with which the detonation and/or booster charge is combined. Fifty gram portions of the above-described particulate explosive can be tightly packed into waxed, paperboard cylinders to one end of which is fixed a detonation charge of 5 grams of DDNP which can then be detonated by conventional means.

EXAMPLE 2

This example illustrates an alternative method within the concept of this invention by which a composition similar to that described in Example 1 can be produced. The ammonium nitrate prills, calcium sulfate and nitrocellulose can be combined in the mixer and heated to 250°F. to promote the reaction of calcium sulfate and ammonium nitrate prills and encapsulating the nitrocellulose in the calcium sulfate-ammonium nitrate reaction product. The resultant particles are then recovered and screened to remove fines and are impregnated with 18 grams of the gas oil described in Example 1 at a temperature of about 120°F. with mechanical mixing to promote even distribution of the gas oil over all of the particles. About 5 minutes of mechanical mixing at a temperature of 120°F. is sufficient to distribute the gas oil and assure its adsorption by the particles. The resultant material can then be compacted and combined with a detonation charge as described in Example 1.

I claim:

1. A particulate high explosive composition comprising at least about 70 weight percent of the particulate reaction product of calcium sulfate dihydrate and ammonium nitrate particles containing at least about 5 weight percent calcium sulfate and at least about 60 weight percent ammonium nitrate based on the dry weight of said calcium sulfate and ammonium nitrate, and about 0.5 to about 20 weight percent of an ammonium nitrate sensitizer dispersed in said calcium sulfate-ammonium nitrate reaction product and selected from the group consisting of dispersed combustible carbonaceous matter, elemental sulfur, zinc, aluminum, magnesium and combinations thereof, wherein said particulate reaction product of said calcium sulfate and ammonium nitrate is produced by the method including the steps of intimately mixing said ammonium nitrate particles and calcium sulfate in finely divided form and heating the resultant mixture to an elevated temperature sufficient to induce the endothermic reaction of calcium sulfate with said ammonium nitrate particles.

2. The composition of claim 1 wherein said carbonaceous matter is selected from the group consisting of mineral and vegetable oils, waxes and distillate residues; powdered coal, coke, charcoal and carbon; finely divided cellulose fibers; and combinations thereof.

3. The composition of claim 1 prepared by the method including the steps of mixing said calcium sulfate, ammonium nitrate particles and sensitizer, heating the resultant mixture to a temperature of at least about 210°F. sufficient to initiate said endothermic reaction and drive off at least some of the water of hydration released during said reaction.

4. The composition of claim 3 wherein said ammonium nitrate particles are ammonium nitrate prills having particle sizes within the range of about 5 to about 30 mesh, said calcium sulfate is admixed with said particles and sensitizer as calcium sulfate dihydrate, and said mixing is conducted under conditions sufficiently anhydrous to prevent the melting or dissolving of said ammonium nitrate particles.

5. The composition of claim 1 containing at least about 0.5 weight percent of another high explosive dispersed in said reaction product of said calcium sulfate and ammonium nitrate.

6. A high explosive composition comprising the particulate high explosive of claim 1 in combination with at least about 0.5 weight percent based on the weight of said combination of at least one other high explosive composition.

7. The high explosive charge comprising at least about 70 weight percent of the particulate high explosive of claim 1 and a booster charge comprising at least about 5 weight percent of a second high explosive sufficient to detonate said particulate high explosive upon detonation of said second explosive.

8. The particulate high explosive composition of claim 1 wherein said sensitizer is selected from the group consisting of elemental sulfur and combustible carbonaceous matter fluid at a temperature below about 300°F., and prepared by the method including the steps of reacting said calcium sulfate dihydrate and particulate ammonium nitrate at said elevated temperature to form particulate combinations of said calcium sulfate and ammonium nitrate particles comprising said reaction product on at least the outer surfaces thereof, and mixing said sensitizer with said combination at a temperature at which said sensitizer is fluid and for a period of time sufficient to disperse said sensitizer in said reaction product.

9. The method of producing the particulate high explosive composition of claim 1 including the steps of mixing said ammonium nitrate sensitizer with said calcium sulfate and ammonium nitrate in either fluid or finely divided solid form, reacting said calcium sulfate dihydrate and ammonium nitrate particles at a temperature of at least about 210°F. sufficient to promote said endothermic reaction and form said particulate reaction product, the particles of which comprise, at least at the outer surfaces thereof, said sensitizer dispersed in the reaction product of said calcium sulfate and ammonium nitrate.

10. The method of claim 9 wherein said particulate high explosive is formed by reacting about 1 to about 10 weight percent of said sensitizer, about 5 to about 20 weight percent of said calcium sulfate dihydrate and at least about 70 weight percent ammonium nitrate particles.

11. The method of claim 9 wherein said reaction of said ammonium nitrate particles and said calcium sulfate is carried out in the presence of said sensitizer and at least about 0.5 weight percent of a second high explosive in finely divided form.

12. The method of producing the particulate high explosive composition of claim 1 wherein said sensitizer is selected from the group consisting of elemental sulfur and carbonaceous matter having a melting point below about 300°F., which method includes the steps of reacting said calcium sulfate dihydrate and said ammonium nitrate particles at said elevated temperature and forming particulate combinations thereof comprising the reaction product of said calcium sulfate and ammonium nitrate at least on the outer surfaces thereof, and mixing said sensitizer with said particulate combinations at a temperature above the melting point thereof, and for a period of time sufficient to disperse said sensitizer in said reaction product.

* * * * *